US010780731B2

(12) United States Patent
Takamura

(10) Patent No.: US 10,780,731 B2
(45) Date of Patent: Sep. 22, 2020

(54) MAIL CREATION METHOD AND IMAGE FORMING SYSTEM

(71) Applicant: KYOCERA Document Solutions Inc., Osaka (JP)

(72) Inventor: Haruna Takamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 144 days.

(21) Appl. No.: 16/047,026

(22) Filed: Jul. 27, 2018

(65) Prior Publication Data

US 2019/0039406 A1 Feb. 7, 2019

(30) Foreign Application Priority Data

Aug. 1, 2017 (JP) ..... 2017-149137

(51) Int. Cl.
*B43M 3/04* (2006.01)
*G03G 15/00* (2006.01)
*B43M 3/02* (2006.01)

(52) U.S. Cl.
CPC ..... *B43M 3/04* (2013.01); *B43M 3/02* (2013.01); *B43M 3/045* (2013.01); *G03G 15/50* (2013.01); *G03G 15/6582* (2013.01); *G03G 15/6594* (2013.01); *G03G 2215/00514* (2013.01); *G03G 2215/00877* (2013.01)

(58) Field of Classification Search
CPC ..... B43M 3/04
USPC ..... 399/407
See application file for complete search history.

(56) References Cited

U.S. PATENT DOCUMENTS 4,959,795 A * 9/1990 Christensen ..... B07C 1/00 270/58.06
4,972,655 A * 11/1990 Ogawa ..... B43M 3/04 156/277
6,141,654 A * 10/2000 Heiden ..... G07B 17/00508 235/375
7,226,494 B1 * 6/2007 Schwartz ..... G06Q 10/00 705/401
8,155,976 B1 * 4/2012 Rendich ..... G06Q 10/087 705/1.1
9,266,298 B2 * 2/2016 Aoto ..... B43M 5/047
10,384,823 B2 * 8/2019 Fujimoto ..... G06K 15/408
2007/0055639 A1 * 3/2007 Garvey ..... B42D 15/006 705/410

(Continued)

FOREIGN PATENT DOCUMENTS

JP S61-221988 A 10/1986

*Primary Examiner* — Anthony H Nguyen
(74) *Attorney, Agent, or Firm* — Studebaker & Brackett PC

(57) ABSTRACT

A mail creation method includes forming an address, forming an image, folding, inserting, sealing, and fixing a voucher. In the forming of the address, an image forming section forms the address on an envelope. In the forming of the image, the image forming section forms the image on paper. In the folding, a folding section folds the paper having the image formed thereon. In the inserting, an enclosing section inserts the folded paper into the envelope having the address formed thereon. In the sealing, the enclosing section seals the envelope having the folded paper inserted therein. In the fixing of the voucher, a voucher fixing section fixes the voucher to the sealed envelope. The voucher indicates that postage has been paid.

10 Claims, 10 Drawing Sheets

(56) References Cited

U.S. PATENT DOCUMENTS

2013/0288871 A1* 10/2013 Aoto ..... B31B 1/88
493/188
2017/0116586 A1* 4/2017 Mimura ..... G06Q 20/102

* cited by examiner

MAIL CREATION METHOD AND IMAGE FORMING SYSTEM

INCORPORATION BY REFERENCE

The present application claims priority under 35 U.S.C. § 119 to Japanese Patent Application No. 2017-149137, filed on Aug. 1, 2017. The contents of this application are incorporated herein by reference in their entirety.

BACKGROUND

The present disclosure relates to a mail creation method and an image forming system.

A mail receiving apparatus includes a weight measuring section, a size measuring section, a recording section, and an adhering section. The weight measuring section measures a weight of an article of mail. The size measuring section measures a size of the article of mail. The recording section records postage according to the weight and the size of the article of mail. The adhering section adheres a postage stamp to the article of mail.

SUMMARY

A mail creation method according to an aspect of the present disclosure includes forming an address, forming an image, folding, inserting, sealing, and fixing a voucher. In the forming of the address, an image forming section forms the address on an envelope. In the forming of the image, the image forming section forms the image on paper. In the folding, a folding section folds the paper having the image formed thereon. In the inserting, an enclosing section inserts the folded paper into the envelope having the address formed thereon. In the sealing, the enclosing section seals the envelope having the folded paper inserted therein. In the fixing of the voucher, a voucher fixing section fixes the voucher to the sealed envelope. The voucher indicates that postage has been paid.

An image forming system according to another aspect of the present disclosure includes an image forming section, a folding section, an enclosing section, and a voucher fixing section. The image forming section forms an address on an envelope and forms an image on paper at different times. The folding section folds the paper having the image formed thereon. The enclosing section inserts the folded paper into the envelope having the address formed thereon and thereafter seals the envelope. The voucher fixing section fixes a voucher to the sealed envelope. The voucher indicates that postage has been paid.

DETAILED DESCRIPTION

An embodiment of the present disclosure will be described as follows with reference to the drawings. Note that elements within the drawings that are the same or equivalent will be referred to with the same reference numbers and description thereof will not be repeated.

Figure 1:
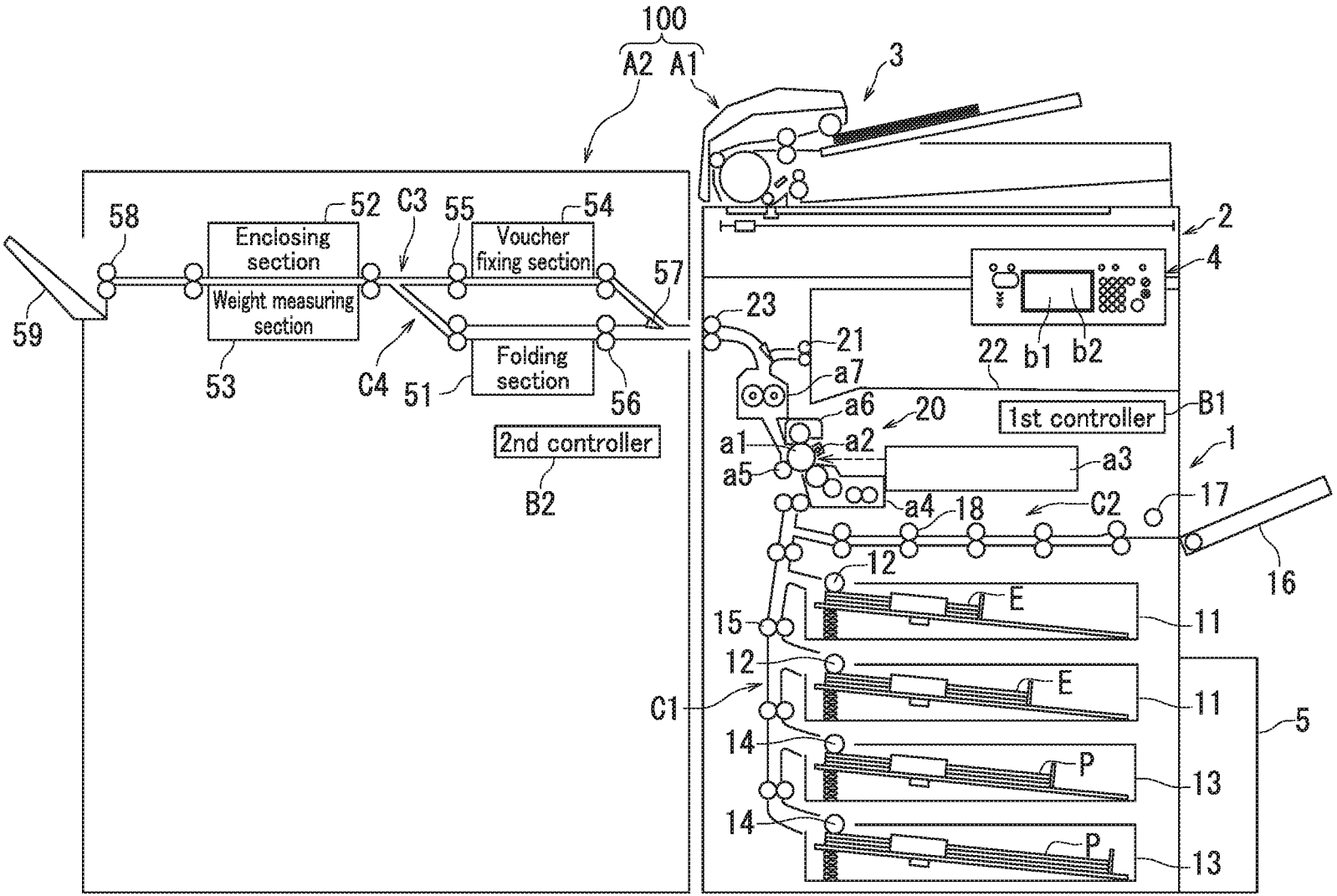
FIG. 1 is a schematic cross-sectional view illustrating an image forming system according to an embodiment of the present disclosure.

First, an image forming system 100 according to the embodiment of the present disclosure will be described with reference to FIG. 1. FIG. 1 is a schematic cross-sectional view illustrating the image forming system 100. As illustrated in FIG. 1, the image forming system 100 includes an image forming apparatus A1 and a post-processing device A2.

The image forming apparatus A1 forms (prints) an address on an envelope E and forms (prints) an image on paper P. The image forming apparatus A1 is a multifunction peripheral (MFP), for example.

Specifically, the image forming apparatus A1 includes an image forming unit 1, an image reading unit 2, an original document conveyance unit 3, an operation panel 4, a money receiving machine 5 (money receiving section), and a first controller B1.

The image forming unit 1 forms the address on the envelope E and forms the image on the paper P. The image reading unit 2 reads an image from an original document. The original document conveyance unit 3 conveys the original document from which the image is read. The operation panel 4 is for a user to operate the image forming apparatus A1 and the post-processing device A2. The operation panel 4 includes a display section b1 that displays an image and an input section b2 that receives input of various information from the user. The input section b2 is a touch panel, for example, located on the display section b1. The money receiving machine 5 receives money inserted by the user. The first controller B1 controls each element of the image forming apparatus A1.

Specifically, the image forming unit 1 includes a plurality of envelope cassettes 11, a plurality of feed rollers 12, a plurality of paper cassettes 13, a plurality of feed rollers 14, a plurality of conveyance rollers 15, a manual feed tray 16, a feed roller 17, a plurality of conveyance rollers 18, an image forming section 20, a first ejection roller 21, a first ejection tray 22, and an output roller 23. The image forming unit 1 includes a first conveyance path C1 and a second conveyance path C2 converging with the first conveyance path C1. The conveyance rollers 15 are located in the first conveyance path C1. The conveyance rollers 18 are located in the second conveyance path C2.

The envelope cassettes 11 each house a plurality of envelopes E. The feed rollers 12 send the envelopes E from the envelope cassettes 11. An envelope E sent by any one of the feed rollers 12 is conveyed to the image forming section 20 through the first conveyance path C1 by the conveyance rollers 15.

The paper cassettes 13 each house multiple sheets of paper P. The feed rollers 14 send the paper P from the paper cassettes 13. The paper P sent by any one of the feed rollers 14 is conveyed to the image forming section 20 through the first conveyance path C1 by the conveyance rollers 15.

An envelope E or paper P is placed on the manual feed tray 16. The feed roller 17 sends the envelope E or the paper P from the manual feed tray 16. Then, the envelope E or the paper P is conveyed to the first conveyance path C1 through the second conveyance path C2 by the conveyance rollers 18. The envelope E or the paper P is then conveyed to the image forming section 20 through the first conveyance path C1 by the conveyance rollers 15.

The image forming section 20 forms the address on the envelope E and forms the image on the paper P at different times. Specifically, the image forming section 20 includes a photosensitive drum a1, a charger a2, an exposure device a3, a developing device a4, a transfer roller a5, a cleaning device a6, and a fixing device a7. The charger a2 charges the photosensitive drum a1 to a predetermined potential. The exposure device a3 forms an electrostatic latent image on the photosensitive drum a1 according to image data by emitting laser light based on the image data to irradiate the photosensitive drum a1. The image data to be used, for example, is read from a removable medium (USB memory or a memory card, for example), received from an external computer (a mobile terminal or a desktop personal computer, for example) through a communication network, or generated by the image reading unit 2 reading the original document.

The developing device a4 supplies toner to develop the electrostatic latent image on the photosensitive drum a1 into a toner image. The transfer roller a5 transfers the toner image on the photosensitive drum a1 to the envelope E or the paper P. When the toner image represents an address (specifically an address image), the address (specifically the address image) is formed on the envelope E. The address includes some or all of the following: a name, a street address, and a postal code. The image data indicating the address is provided from the removable medium or the external computer. When the toner image represents an image, the image is formed on the paper P. The image represents one or more of characters, photographs, and pictures, for example. The characters may be letters, numbers, or marks, for example. The image data indicating the image is provided from the removable medium, the external computer, or the image reading unit 2.

The cleaning device a6 removes remaining toner from the photosensitive drum a1 after image transfer. The fixing device a7 fixes the toner image to the envelope E or the paper P by applying heat and pressure thereto. The envelope E or the paper P with the toner image fixed thereon is output to the post-processing device A2 by the output roller 23. When the paper P is not to be inserted into an envelope E, the paper P with the toner image fixed thereto may be ejected to the first ejection tray 22 by the first ejection roller 21.

The post-processing device A2 receives the envelope E with the address formed thereon and the paper P with the image formed thereon from the image forming apparatus A1. Then, the post-processing device A2 performs post-processing on the envelope E and the paper P received from the image forming apparatus A1. The post-processing includes a folding process for the paper P, an enclosure process of the paper P into the envelope E, and a voucher fixing process for the envelope E. A voucher indicates that postage has been paid. The voucher is a postage stamp or a meter mark, for example. Note that post-processing may include either or both of a punching process and a stapling process. The punching process is to form a punched hole in the paper P. The stapling process is to bind sheets of the paper P with a binding tool such as a staple.

Specifically, the post-processing device A2 includes a folding section 51, an enclosing section 52, a weight measuring section 53, a voucher fixing section 54, a plurality of conveyance rollers 55, a plurality of conveyance rollers 56, a diverging guide 57, a second ejection roller 58, a second ejection tray 59, and a second controller B2. The second controller B2 controls each element of the post-processing device A2. The post-processing device A2 also includes a third conveyance path C3 and a fourth conveyance path C4. The fourth conveyance path C4 diverges from the third conveyance path C3 and reconverges with the third conveyance path C3. The diverging guide 57 is located at a diverging point of the fourth conveyance path C4.

The enclosing section 52, the weight measuring section 53, and the voucher fixing section 54 are located along the third conveyance path C3. The folding section 51 is located along the fourth conveyance path C4. The conveyance rollers 55 are located in the third conveyance path C3. The conveyance rollers 56 are located in the fourth conveyance path C4. The second ejection roller 58 is located at the exit of the third conveyance path C3.

Operation of the post-processing device A2 will be described in relation to the image forming apparatus A1 with further reference to FIG. 1. After the envelope E is outputted by the output roller 23 of the image forming apparatus A1, the diverging guide 57 of the post-processing device A2 guides the envelope E to the third conveyance path C3. The address has been formed on the envelope E. Then, the conveyance rollers 55 convey the envelope E to the enclosing section 52.

After the paper P is outputted by the output roller 23 of the image forming apparatus A1 by contrast, the diverging guide 57 guides the paper P to the fourth conveyance path C4. The image has been formed on the paper P. The conveyance rollers 56 convey the paper P to the folding section 51. The folding section 51 folds the paper P. The conveyance rollers then 56 convey the folded paper P to the third conveyance path C3. The conveyance rollers 55 then convey the folded paper P to the enclosing section 52.

The enclosing section 52 opens the opening of the envelope E and inserts the folded paper P into the envelope E. The weight measuring section 53 measures the weight of the envelope E with the paper P inserted therein. The enclosing section 52 then seals the envelope E with the paper P inserted therein. The conveyance rollers 55 then convey the sealed envelope E to the voucher fixing section 54. The voucher fixing section 54 fixes the voucher to the sealed envelope E. As a result, an article of mail is created. The conveyance rollers 55 then convey the envelope E with the voucher fixed thereto to the second ejection roller 58. The second ejection roller 58 then ejects the sealed envelope E to the second ejection tray 59. Note that the inserting of the paper P into the envelope E and the sealing of the envelope E may be referred to as "enclosing".

According to the present embodiment as described above with reference to FIG. 1, the image forming section 20 forms the address and the image, the folding section 51 folds the paper P, the enclosing section 52 encloses the paper P in the envelope E, and the voucher fixing section 54 fixes (adheres, for example) the voucher (stamp, for example) to the envelope E. That is, the image forming system 100 performs a series of jobs from address forming and image forming to voucher fixing. Therefore, labor and burden can be reduced for a person (specifically the user) processing mail.

Also according to the present embodiment, the image forming system 100 has an address forming mode, an address non-forming mode, and an unspecified paper mode as mail creation modes. The address forming mode means a mode in which the image forming section 20 forms an address on an envelope E to create an article of mail. The address non-forming mode means a mode in which the image forming section 20 creates an article of mail without forming an address on an envelope E. The unspecified paper mode means a mode in which the image forming system 100 creates an article of mail without specifying a size of paper P.

Accordingly, the user can select a desired mode from the address forming mode, the address non-forming mode, and the unspecified paper mode through the input section b2 to create an article of mail with the image forming system 100.

An example of the folding section 51, the enclosing section 52, the weight measuring section 53, and the voucher fixing section 54 will be described with further reference to FIG. 1.

The folding section 51 includes a blade (unillustrated) and a pair of sheet folding rollers (unillustrated). The blade and a nip part between the sheet folding rollers are located opposite to each other. Paper is placed between the blade and the nip part between the sheet folding rollers. The blade then inserts the paper into the nip part between the sheet folding rollers while making contact with a main surface of the paper and thus folding the paper. The sheet folding rollers then rotate while folding the paper through the nip part. As a result, the paper is folded.

The enclosing section 52 includes an opening claw (unillustrated), a crease inserting mechanism (unillustrated), a conveyance roller (unillustrated), and a pair of flap closing rollers (unillustrated). The opening claw opens the opening of an envelope. The conveyance roller conveys the paper and inserts the paper into the envelope. The crease inserting mechanism inserts a creased part of a flap of the envelope with the paper inserted therein into a nip part between the flap closing rollers. The flap closing rollers fold the flap by rotating, and seal the envelope. Note that adhesive is pre-applied or double-sided adhesive tape is pre-adhered to the flap. However, the enclosing section 52 may further include an adhesion mechanism (unillustrated). The adhesion mechanism applies adhesive to the flap before processing by the crease inserting mechanism.

The weight measuring section 53 includes a weight sensor (unillustrated) such as a load cell. The weight sensor measures the weight of the envelope with the paper inserted therein.

The voucher fixing section 54 adheres a postage stamp as the voucher to the envelope. Specifically, the voucher fixing section 54 includes a plurality of rolls (unillustrated), a plurality of cutters (unillustrated) arranged corresponding to the rolls, and an adhering mechanism (unillustrated). Stamp tape is wrapped around each roll. The stamp tape includes a plurality of postage stamps arranged in a straight line. The price of a stamp varies by roll. Each of the cutters cuts the stamp tape extended from a corresponding roll to separate a postage stamp from the stamp tape. The adhering mechanism then applies glue or liquid to the postage stamp to adhere the postage stamp to the envelope.

Alternatively, the voucher fixing section 54 forms a meter mark as the voucher on the envelope. Specifically, the voucher fixing section 54 includes a plurality of stamps (unillustrated) and an impressing mechanism (unillustrated). Each of the stamps represents a meter mark. The price of the meter mark varies by stamp. The impressing mechanism presses a stamp to the envelope to form the meter mark on the envelope.

Note that the folding section 51 is a folding machine, the enclosing section 52 is an inserter, the weight measuring section 53 is a weight measuring machine, and the voucher fixing section 54 is a voucher fixing machine, for example.

Figure 2:
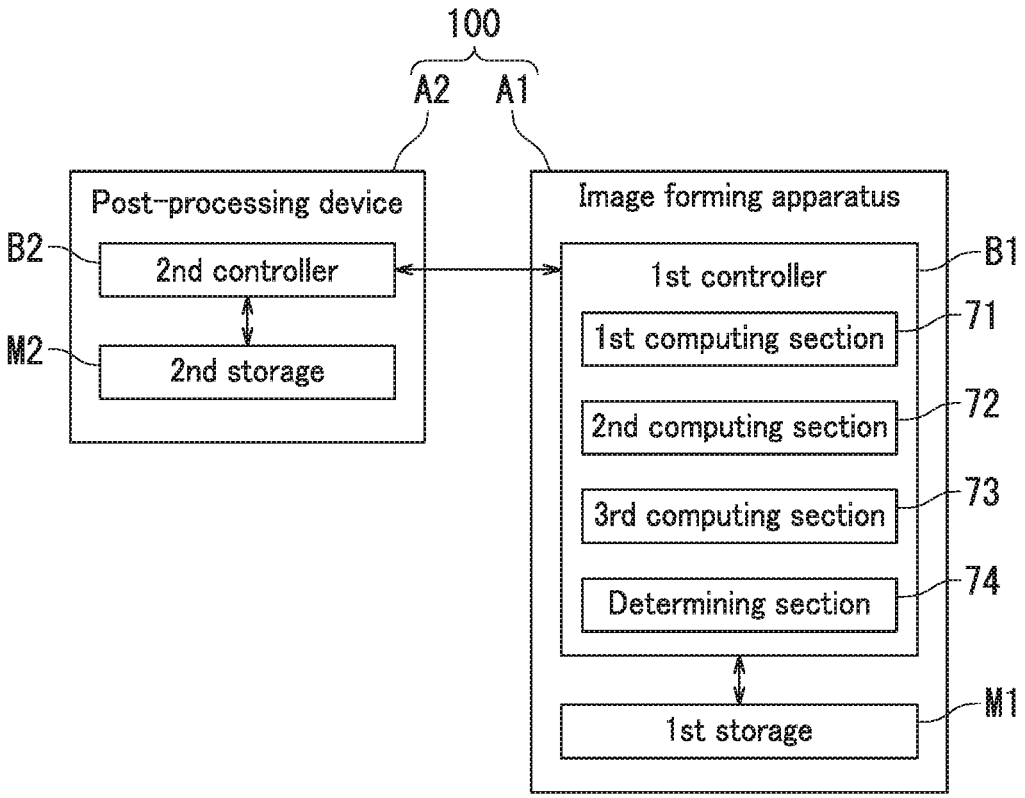
FIG. 2 is a functional block diagram illustrating a first controller and a second controller according to the embodiment.

Next, the first controller B1 and the second controller B2 will be described with reference to FIG. 2. FIG. 2 is a functional block diagram illustrating the first controller B1 and the second controller B2. As illustrated in FIG. 2, the image forming apparatus A1 further includes first storage M1 in addition to the first controller B1. The post-processing device A2 further includes second storage M2 in addition to the second controller B2. The first controller B1 and the second controller B2 communicate with each other. The first controller B1 then controls the post-processing device A2 through the second controller B2. The second controller B2 transmits information indicating a state of the folding section 51, the enclosing section 52, the weight measuring section 53, and the voucher fixing section 54 to the first controller B1.

The first controller B1 and the second controller B2 each include a processor such as a central processing unit (CPU). The first storage M1 and the second storage M2 each store various data and computer programs. The first storage M1 and the second storage M2 each include a storage device. The storage device includes a main storage device such as semiconductor memory as well as an auxiliary storage device such as semiconductor memory and a hard disk drive.

The first controller B1 includes a first computing section 71, a second computing section 72, a third computing section 73, and a determining section 74. Specifically, the processor of the first controller B1 functions as the first computing section 71, the second computing section 72, the third computing section 73, and the determining section 74 by executing a computer program stored in the first storage M1. The first computing section 71, the second computing section 72, the third computing section 73, and the determining section 74 will be later described with reference to FIGS. 1 to 10. The processor of the first controller B1 also controls the image forming unit 1 by executing a computer program stored in the first storage M1. By contrast, the processor of the second controller B2 controls the folding section 51, the enclosing section 52, the weight measuring section 53, and the voucher fixing section 54 by executing a computer program stored in the second storage M2.

Next, a mail creation method according to the present embodiment will be described with reference to FIGS. 1 to 10. FIGS. 3 to 9 are flowcharts illustrating the mail creation method. As illustrated in FIGS. 3 to 9, the mail creation method includes Steps S1 to S177. The mail creation method includes the address forming mode, the address non-forming mode, and the unspecified paper mode. The image forming system 100 performs the mail creation method.

Figure 3:
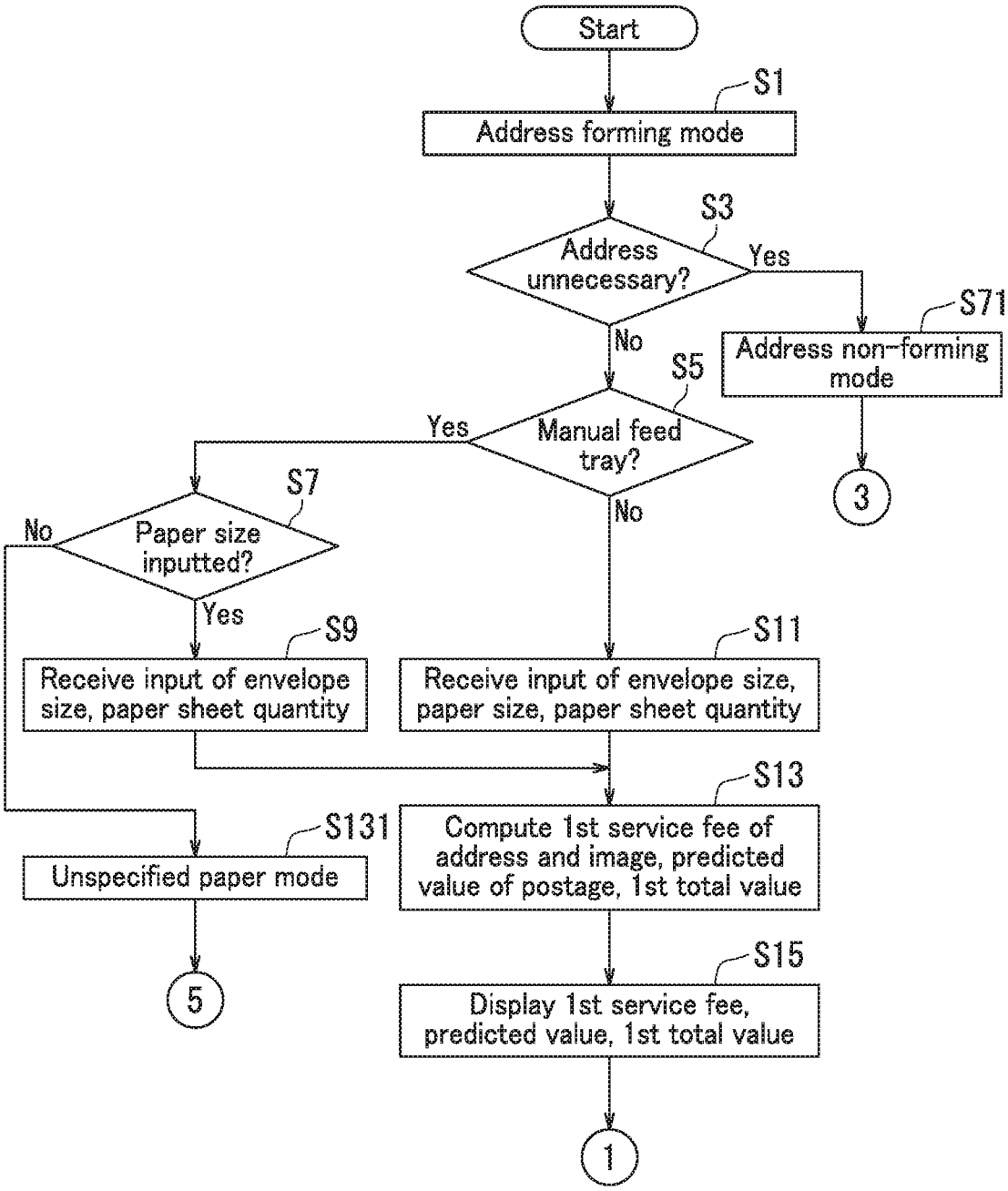
FIG. 3 is a flowchart illustrating a portion of a mail creation method according to the embodiment.

As illustrated in FIGS. 1 to 3, the first controller B1 sets the mail creation mode to the address forming mode in Step S1.

In Step S3, the determining section 74 determines whether or not the input section b2 has received input of first information. The first information indicates that formation of an address is unnecessary.

When the determining section 74 determines that the input of the first information has been received (Yes in Step S3), the process advances to Step S71.

In Step S71, the first controller B1 sets the mail creation mode to the address non-forming mode. The process then advances to Step S73 in FIG. 6. The reception of the input of the first information by the input section b2 is equivalent to selection of the address non-forming mode. For example, the user selects the address non-forming mode when bringing an envelope E with an address written thereon.

When the determining section 74 determines that the input of the first information has not been received by contrast (No in Step S3), the process advances to Step S5.

In Step S5, the determining section 74 determines whether or not the input section b2 has received input of second information. The second information indicates that an image is to be formed on paper P placed on the manual feed tray 16.

When the determining section 74 determines that the input of the second information has not been received (No in Step S5), the process advances to Step S11.

In Step S11, the input section b2 receives input of a size of the envelope E, the size of the paper P, and a sheet quantity of the paper P on which the image is to be formed. The process then advances to Step S13.

When the determining section 74 determines that the input of the second information has been received by contrast (Yes in Step S5), the process advances to Step S7.

In Step S7, the determining section 74 determines whether or not the input section b2 has received input of third information. The third information indicates the size of the paper P on which the image is to be formed.

When the determining section 74 determines that the input of the third information has been received (Yes in Step S7), the process advances to Step S9.

In Step S9, the input section b2 receives input of the size of the envelope E and the sheet quantity of the paper P on which the image is to be formed. The process then advances to Step S13.

When the determining section 74 determines that the input of the third information has not been received by contrast (No in Step S7), the process advances to Step S131. Non-reception of the input of the third information indicates that the size of the paper P is not specified.

In Step S131, the first controller B1 sets the mail creation mode to the unspecified paper mode. The process then advances to Step S133 in FIG. 8. The non-reception of the input of the third information by the input section b2 is equivalent to selection of the unspecified paper mode. For example, the user selects the unspecified paper mode when bringing paper P of an unknown size.

After a negative determination in Step S5 or a positive determination in Step S7, the mail creation mode remains set to the address forming mode in Steps S9 to S55.

In Step S13, the first computing section 71 computes a first service fee F1, a predicted value PV of the postage, and a first total value SM1 based on the size of the envelope E (rectangular #2, for example), the size of the paper P (A4, for example), and the sheet quantity of the paper P received by the input section b2. The first service fee F1 indicates a fee for a service of forming the address on the envelope E and forming the image on the paper P. The first total value SM1 indicates a total value of the first service fee F1 and the predicted value PV.

For example, the first computing section 71 adds "1" which is a quantity of envelopes E to the sheet quantity of the paper P to compute a sum. The first computing section 71 then multiplies an image formation unit price by the sum to compute a product. The product indicates the first service fee F1. The image formation unit price indicates a fee when images (including the address) are formed on one sheet of paper P or one envelope E.

For example, the first computing section 71 refers to a first weight table WT1 to specify a unit weight of the paper P based on the size of the paper P. The first weight table WT1 associates the size of the paper P with the unit weight of the paper P. The unit weight of the paper P indicates the weight of one sheet of the paper P. The first computing section 71 also refers to a second weight table WT2 to specify a unit weight of the envelope E based on the size of the envelope E. The second weight table WT2 associates the size of the envelope E with the unit weight of the envelope E. The unit weight of the envelope E indicates the weight of one envelope E. The first computing section 71 multiplies the sheet quantity of the paper P by the unit weight of the paper P to compute a product. The first computing section 71 then adds the unit weight of the envelope E to the product to compute a sum. The sum indicates a predicted value of the weight of the envelope E with the paper P inserted therein, or rather the predicted value of the weight of the article of mail. The first computing section 71 then refers to a fee table FT to specify the postage based on the size of the envelope E and the predicted value of the weight of the article of mail. The fee table FT associates the size of the envelope E, the weight of the article of mail, and the postage.

Note that the postage specified by the first computing section 71 is postage based on a predicted value of the weight of the article of mail, not postage based on the actual value of the weight of the article of mail. Accordingly, the postage specified by the first computing section 71 indicates the predicted value PV of the postage. The first storage M1 also stores the first weight table WT1, the second weight table WT2, and the fee table FT.

In Step S15, the display section b1 displays the first service fee F1, the predicted value PV of the postage, the first total value SM1, and a message. The process then advances to Step S17 in FIG. 4. The message includes content requesting payment of a fee equivalent to the first total value SM1.

Figure 10:
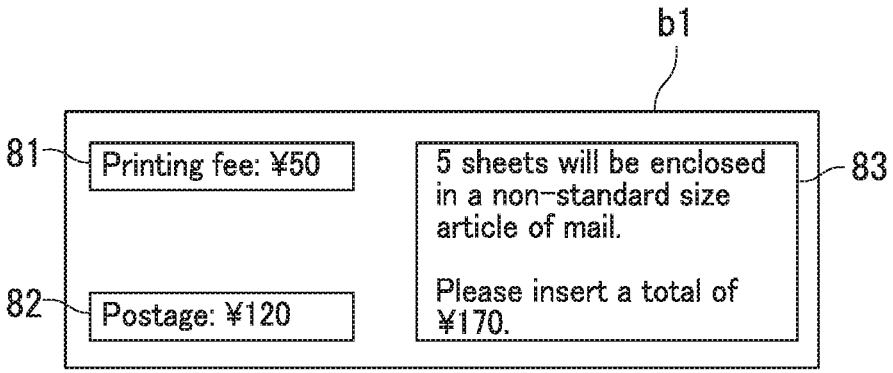
FIG. 10 is a diagram illustrating a display section according to the embodiment.

Next, the display section b1 will be described with reference to FIG. 10. FIG. 10 is a diagram illustrating the display section b1. As illustrated in FIG. 10, the display section b1 includes a first area 81, a second area 82, and a third area 83. The display section b1 displays the first service fee F1 ("Printing fee: ¥50" for example) in the first area 81. The display section b1 displays the predicted value PV of the postage ("Postage: ¥120" for example) in the second area 82. The display section b1 displays the first total value SM1 ("Total: ¥170" for example) and the message in the third area 83.

Figure 4:
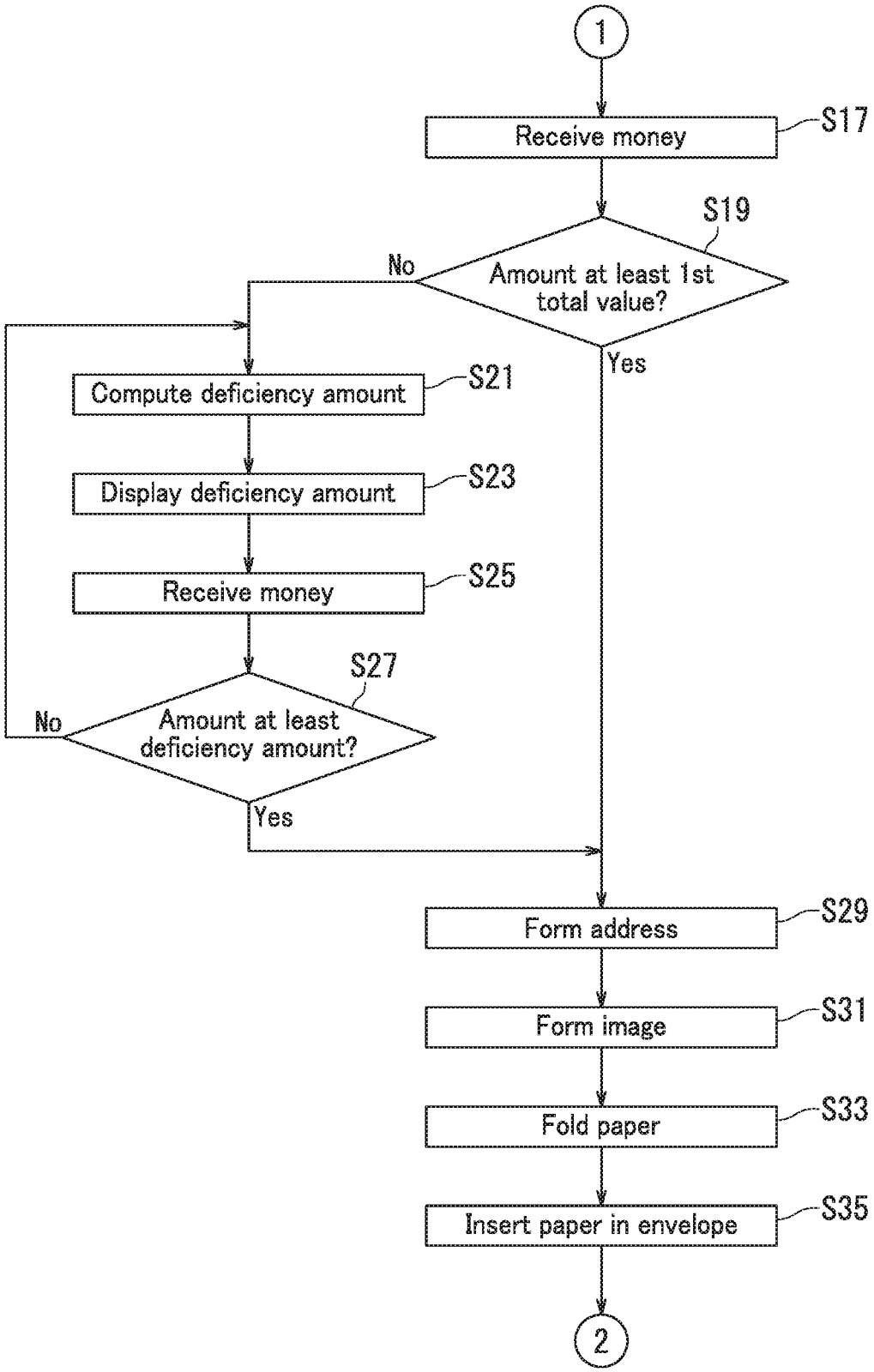
FIG. 4 is a flowchart illustrating another portion of the mail creation method according to the embodiment.

Next, the process of the address forming mode will be further described with reference to FIG. 4. As illustrated in FIG. 4, the money receiving machine 5 receives money and computes an amount of received money in Step S17.

In Step S19, the determining section 74 determines whether or not the amount of received money is equal to or greater than the first total value SM1.

When the determining section 74 determines that the amount of received money is equal to or greater than the first total value SM1 (Yes in Step S19), the process advances to Step S29.

When the determining section 74 determines that the amount of received money is less than the first total value SM1 by contrast (No in Step S19), the process advances to Step S21.

In Step S21, the third computing section 73 computes a fee deficiency amount (specifically a deficiency amount relative to the first total value SM1) based on the first total value SM1 and the amount of received money. The deficiency amount is a value computed by subtracting the amount of received money from the first total value SM1.

In Step S23, the display section b1 displays the deficiency amount and a message. The message includes content requesting payment of the deficiency amount.

In Step S25, the money receiving machine 5 receives money and computes an amount of received money.

In Step S27, the determining section 74 determines whether or not the amount of money received in Step S25 is equal to or greater than the deficiency amount.

When the determining section 74 determines that the amount of received money is less than the deficiency amount (No in Step S27), the process returns to Step S21.

When the determining section 74 determines that the amount of received money is equal to or greater than the deficiency amount by contrast (Yes in Step S27), the process advances to Step S29.

In Step S29, the image forming section 20 forms the address on the envelope E. The image forming apparatus A1 then outputs the envelope E with the address formed thereon to the post-processing device A2. The post-processing device A2 receives the envelope E and conveys the envelope E to the enclosing section 52. Step S29 is equivalent to an example of "forming an address".

In Step S31, the image forming section 20 forms the image on the paper P. The image forming apparatus A1 then outputs the paper P with the image formed thereon to the post-processing device A2. The post-processing device A2 receives the paper P and conveys the paper P to the folding section 51. Step S31 is equivalent to an example of "forming an image".

In Step S33, the folding section 51 folds the paper P with the image formed thereon. The folded paper P is then conveyed from the folding section 51 to the enclosing section 52. Step S33 is equivalent to an example of "folding".

In Step S35, the enclosing section 52 opens the opening of the envelope E with the address formed thereon and inserts the folded paper P into the envelope E. The process then advances to Step S37 in FIG. 5. Step S35 is equivalent to an example of "inserting".

Figure 5:
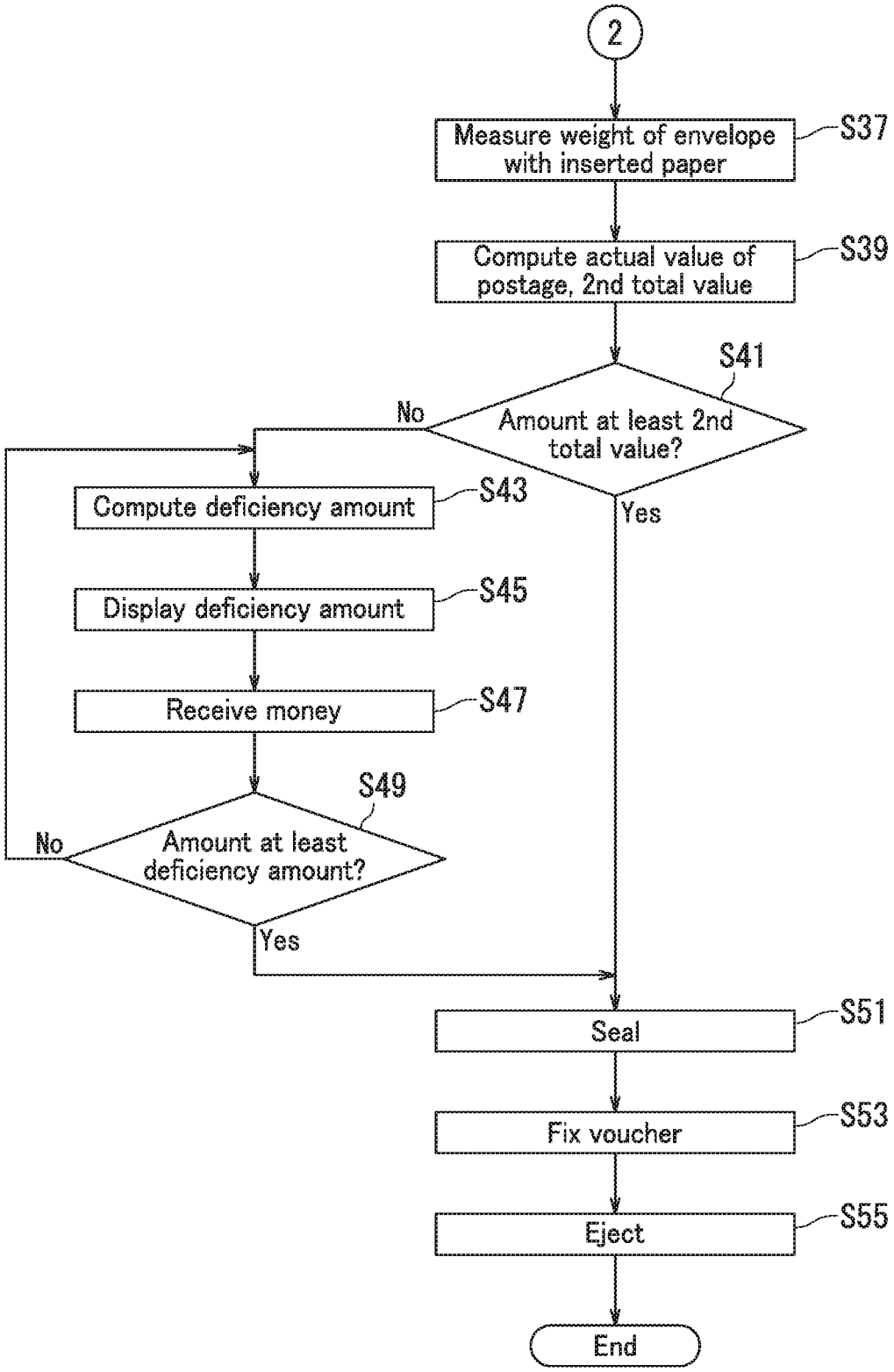
FIG. 5 is a flowchart illustrating another portion of the mail creation method according to the embodiment.

As illustrated in FIG. 5, in Step S37, the weight measuring section 53 measures the weight of the envelope E with the folded paper P inserted therein.

In Step S39, the second computing section 72 computes an actual value AV of the postage and a second total value SM2, based on the size of the envelope E and the actual value of the weight of the envelope E with the folded paper P inserted therein. The second total value SM2 indicates a total value of the first service fee F1 and the actual value AV of the postage. Note that the display section b1 may display the first service fee F1, the actual value AV of the postage, and the second total value SM2.

For example, the second computing section 72 refers to the fee table FT to specify the postage based on the size of the envelope E and the actual value of the weight of the envelope E with the paper P inserted therein (that is, the actual value of the weight of the article of mail). Note that the postage specified by the second computing section 72 is postage based on the actual value of the weight of the article of mail. Accordingly, the postage specified by the second computing section 72 indicates the actual value AV of the postage.

In Step S41, the determining section 74 determines whether or not the amount of money received by the money receiving machine 5 before Step S41 is equal to or greater than the second total value SM2. The "amount of money received by the money receiving machine 5 before Step S41" means a total amount of the amounts of money received in Steps S17 and S25.

When the determining section 74 determines that the amount of received money is equal to or greater than the second total value SM2 (Yes in Step S41), the process advances to Step S51.

When the determining section 74 determines that the amount of received money is less than the second total value SM2 (No in Step S41), the process advances to Step S43.

In Step S43, the third computing section 73 computes a fee deficiency amount (specifically a deficiency amount relative to the second total value SM2) based on the second total value SM2 and the amount of received money. The deficiency amount is a value computed by subtracting the amount of received money from the second total value SM2.

In Step S45, the display section b1 displays the deficiency amount and a message. The message includes content requesting payment of the deficiency amount.

In Step S47, the money receiving machine 5 receives money and computes the amount of received money.

In Step S49, the determining section 74 determines whether or not the amount of money received in Step S47 is equal to or greater than the deficiency amount.

When the determining section 74 determines that the amount of received money is less than the deficiency amount (No in Step S49), the process returns to Step S43. That is, when the determining section 74 determines that the amount of received money is less than the deficiency amount, the enclosing section 52 defers performance of Step S51 and the voucher fixing section 54 defers performance of Step S53.

When the determining section 74 determines that the amount of received money is equal to or greater than the deficiency amount by contrast (Yes in Step S49), the process advances to Step S51.

In Step S51, the enclosing section 52 seals the envelope E with the folded paper P inserted therein. The sealed envelope E is then conveyed from the enclosing section 52 to the voucher fixing section 54. Step S51 is equivalent to an example of "sealing".

In Step S53, the voucher fixing section 54 fixes the voucher to the sealed envelope E. As a result, the article of mail is created. The envelope E with the voucher fixed thereto is then conveyed from the voucher fixing section 54 to the second ejection roller 58. Step S53 is equivalent to an example of "fixing a voucher".

In Step S55, the second ejection roller 58 ejects the envelope E to the second ejection tray 59.

Figure 6:
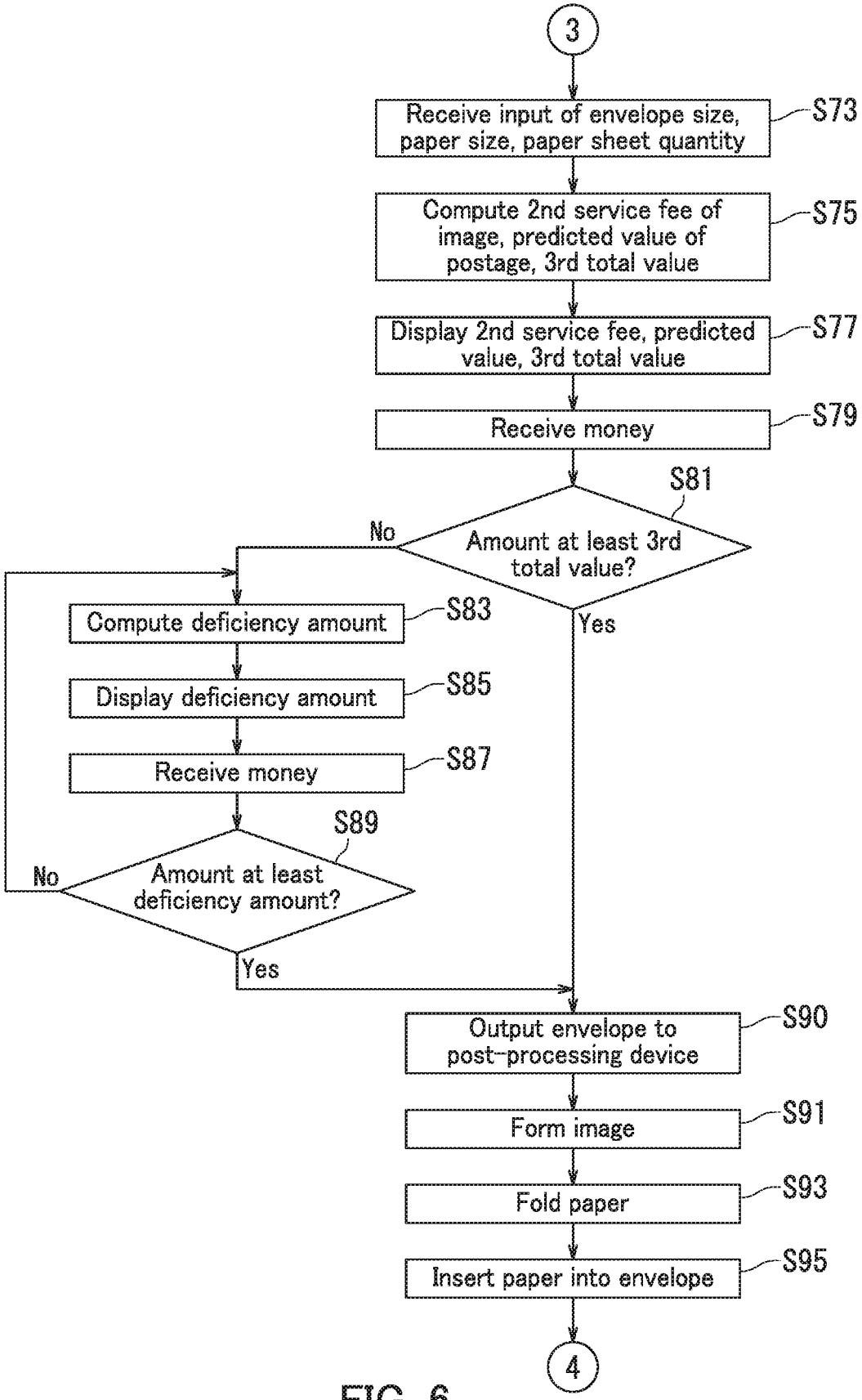
FIG. 6 is a flowchart illustrating another portion of the mail creation method according to the embodiment.

Next, a process of the address non-forming mode will be described with reference to FIGS. 3, 6, and 7. As illustrated in FIG. 6, in Step S73 after Step S71 in FIG. 3, the input section b2 receives input of the size of the envelope E, the size of the paper P. and the sheet quantity of the paper P on which the image is to be formed.

In Step S75, the first computing section 71 computes a second service fee F2, the predicted value PV of the postage, and a third total value SM3 based on the size of the envelope E, the size of the paper P, and the sheet quantity of the paper P received by the input section b2. The second service fee F2 indicates a fee for a service of forming the image on the paper P without forming an address on the envelope E. The third total value SM3 indicates a total value of the second service fee F2 and the predicted value PV.

For example, the first computing section 71 multiplies an image formation unit price by the sheet quantity of the paper P to compute a product. The product indicates the second service fee F2. The image formation unit price indicates a fee when the image is formed on one sheet of the paper P. Note that the predicted value PV is computed in the same manner as Step S13 in FIG. 3.

In Step S77, the display section b1 displays the second service fee F2, the predicted value PV of the postage, the third total value SM3, and a message. The message includes content requesting payment of a fee equivalent to the third total value SM3.

In Step S79, the money receiving machine 5 receives money and computes an amount of received money.

In Step S81, the determining section 74 determines whether or not the amount of received money is equal to or greater than the third total value SM3.

When the determining section 74 determines that the amount of received money is equal to or greater than the third total value SM3 (Yes in Step S81), the process advances to Step S90.

When the determining section 74 determines that the amount of received money is less than the third total value SM3 by contrast (No in Step S81), the process advances to Step S83.

In Step S83, the third computing section 73 computes a fee deficiency amount (specifically a deficiency amount relative to the third total value SM3) based on the third total value SM3 and the amount of received money. The deficiency amount is a value computed by subtracting the amount of received money from the third total value SM3.

In Step S85, the display section b1 displays the deficiency amount and a message. The message includes content requesting payment of the deficiency amount.

In Step S87, the money receiving machine 5 receives money and computes an amount of received money.

In Step S89, the determining section 74 determines whether or not the amount of money received in Step S87 is equal to or greater than the deficiency amount.

When the determining section 74 determines that the amount of received money is less than the deficiency amount (No in Step S89), the process returns to Step S83.

When the determining section 74 determines that the amount of received money is equal to or greater than the deficiency amount by contrast (Yes in Step S83), the process advances to Step S90.

In Step S90, the image forming apparatus A1 acquires the envelope E from the manual feed tray 16 and outputs the envelope E to the post-processing device A2. The post-processing device A2 receives the envelope E and conveys the envelope E to the enclosing section 52.

In Step S91, the image forming section 20 forms the image on the paper P. The image forming apparatus A1 then outputs the paper P with the image formed thereon to the post-processing device A2. The post-processing device A2 receives the paper P and conveys the paper P to the folding section 51.

In Step S93, the folding section 51 folds the paper P with the image formed thereon. The folded paper P is then conveyed from the folding section 51 to the enclosing section 52.

In Step S95, the enclosing section 52 opens the opening of the envelope E with the address formed thereon and inserts the folded paper P into the envelope E. The process then advances to Step S97 in FIG. 7.

Figure 7:
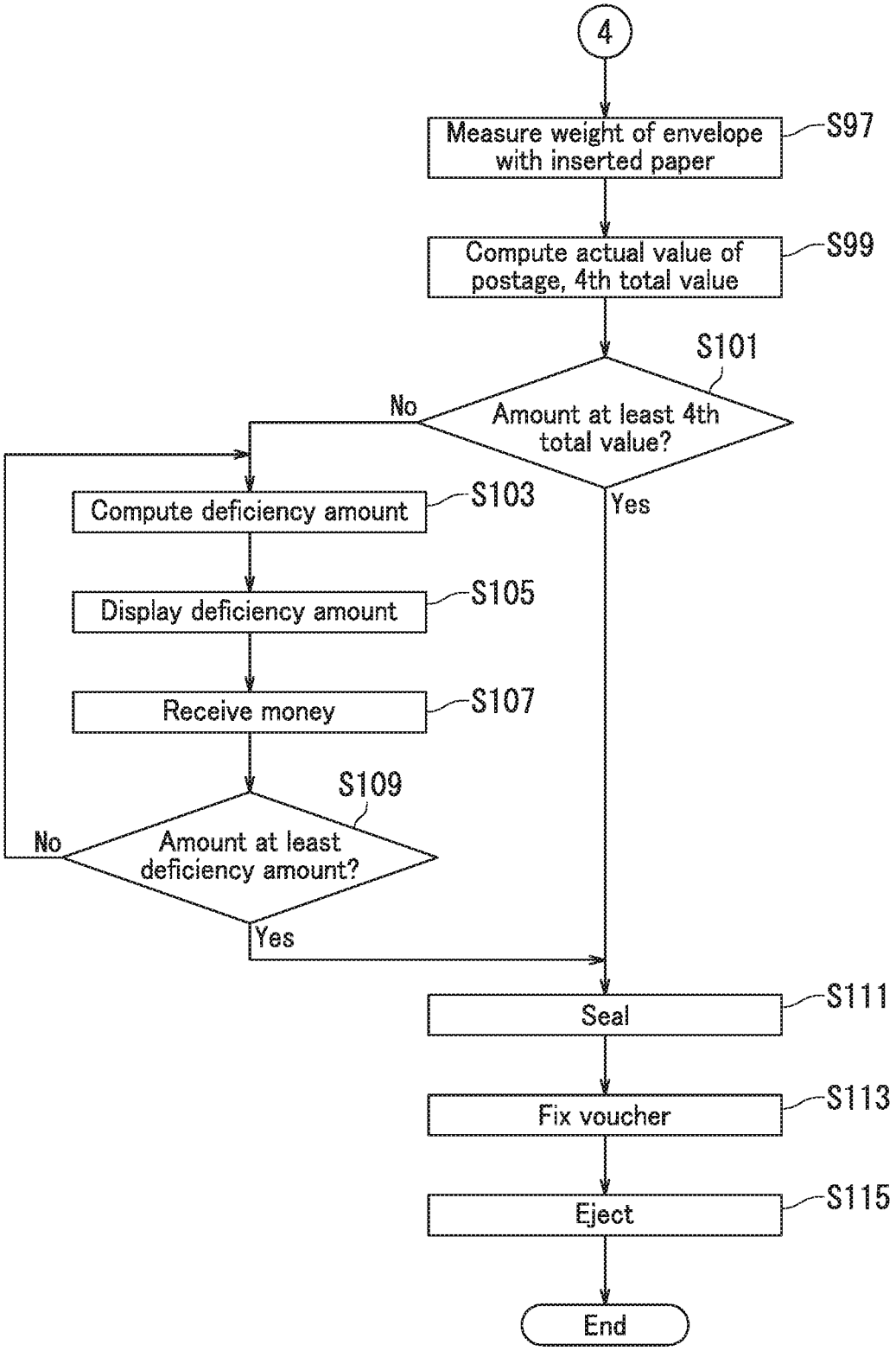
FIG. 7 is a flowchart illustrating another portion of the mail creation method according to the embodiment.

As illustrated in FIG. 7, in Step S97, the weight measuring section 53 measures the weight of the envelope E with the folded paper P inserted therein.

In Step S99, the second computing section 72 computes the actual value AV of the postage and a fourth total value SM4, based on the size of the envelope E and the actual value of the weight of the envelope E with the folded paper P inserted therein. The fourth total value SM4 means a total value of the second service fee F2 and the actual value AV of the postage. Note that the display section b1 may display the second service fee F2, the actual value AV of the postage, and the fourth total value SM4.

In Step S101, the determining section 74 determines whether or not the amount of money received by the money receiving machine 5 before Step S101 is equal to or greater than the fourth total value SM4. The "amount of money received by the money receiving machine 5 before Step S101" means a total amount of the amounts of money received in Steps S79 and S87.

When the determining section 74 determines that the amount of received money is equal to or greater than the fourth total value SM4 (Yes in Step S101), the process advances to Step S111.

When the determining section 74 determines that the amount of received money is less than the fourth total value SM4 by contrast (No in Step S101), the process advances to Step S103.

In Step S103, the third computing section 73 computes a fee deficiency amount (specifically a deficiency amount relative to the fourth total value SM4) based on the fourth total value SM4 and the amount of received money. The deficiency amount is a value computed by subtracting the amount of received money from the fourth total value SM4.

In Step S105, the display section b1 displays the deficiency amount and a message. The message includes content requesting payment of the deficiency amount.

In Step S107, the money receiving machine 5 receives money and computes an amount of received money.

In Step S109, the determining section 74 determines whether or not the amount of money received in Step S47 is equal to or greater than the deficiency amount.

When the determining section 74 determines that the amount of received money is less than the deficiency amount (No in Step S109), the process returns to Step S103. That is, when the determining section 74 determines that the amount of received money is less than the deficiency amount, the enclosing section 52 defers performance of Step S111 and the voucher fixing section 54 defers performance of Step S113.

When the determining section 74 determines that the amount of received money is equal to or greater than the deficiency amount by contrast (Yes in Step S109), the process advances to Step S111.

In Step S111, the enclosing section 52 seals the envelope E with the folded paper P inserted therein. The sealed envelope E is then conveyed from the enclosing section 52 to the voucher fixing section 54.

In Step S113, the voucher fixing section 54 fixes the voucher to the sealed envelope E. As a result, the article of mail is created. The envelope E with the voucher fixed thereto is then conveyed from the voucher fixing section 54 to the second ejection roller 58.

In Step S115, the second ejection roller 58 ejects the envelope E to the second ejection tray 59.

Figure 8:
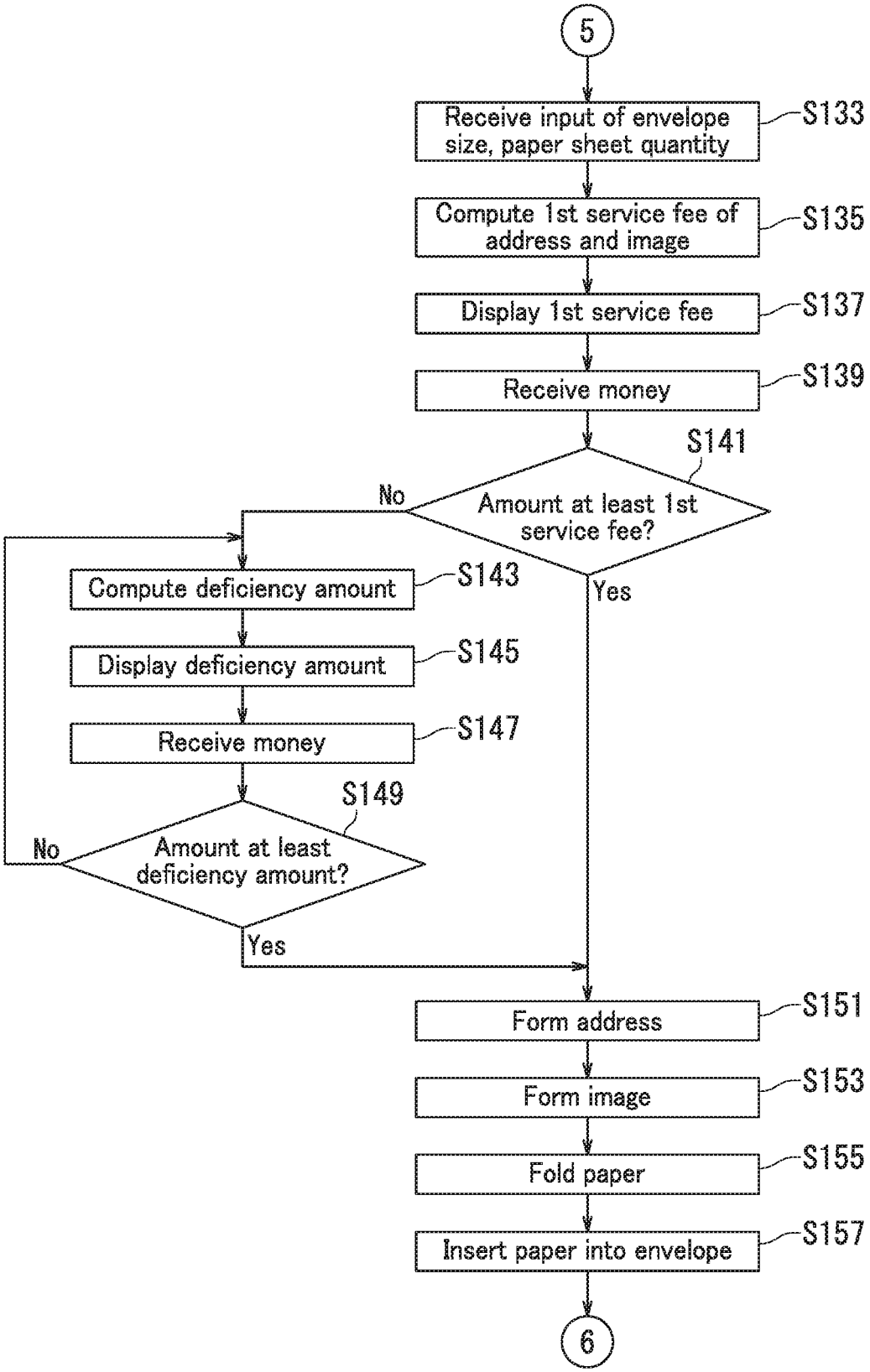
FIG. 8 is a flowchart illustrating another portion of the mail creation method according to the embodiment.

Next, a process of the unspecified paper mode will be described with reference to FIGS. 3, 8, and 9. As illustrated in FIG. 8, in Step S133 after Step S131 in FIG. 3, the input section b2 receives input of the size of the envelope E and the sheet quantity of the paper P on which the image is to be formed.

In Step S135, the first computing section 71 computes the first service fee F1 based on the sheet quantity of the paper P received by the input section b2.

In Step S137, the display section b1 displays the first service fee F1 and a message. The message includes content requesting payment of the first service fee F1.

In Step S139, the money receiving machine 5 receives money and computes an amount of received money.

In Step S141, the determining section 74 determines whether or not the amount of received money is equal to or greater than the first service fee F1.

When the determining section 74 determines that the amount of received money is equal to or greater than the first service fee F1 (Yes in Step S141), the process advances to Step S151.

When the determining section 74 determines that the amount of received money is less than the first service fee F1 by contrast (No in Step S141), the process advances to Step S143.

In Step S143, the third computing section 73 computes a fee deficiency amount (specifically a deficiency amount relative to the first service fee F1) based on the first service fee F1 and the amount of received money. The deficiency amount is a value computed by subtracting the amount of received money from the first service fee F1.

In Step S145, the display section b1 displays the deficiency amount and a message. The message includes content requesting payment of the deficiency amount.

In Step S147 the money receiving machine 5 receives money and computes an amount of received money.

In Step S149, the determining section 74 determines whether or not the amount of money received in Step S147 is equal to or greater than the deficiency amount.

When the determining section 74 determines that the amount of received money is less than the deficiency amount (No in Step S149), the process returns to Step S143.

When the determining section 74 determines that the amount of received money is equal to or greater than the deficiency amount by contrast (Yes in Step S149), the process advances to Step S151.

In Step S151, the image forming section 20 forms the address on the envelope E. The image forming apparatus A1 then outputs the envelope E with the address formed thereon to the post-processing device A2. The post-processing device A2 receives the envelope E and conveys the envelope E to the enclosing section 52.

In Step S153, the image forming section 20 forms the image on the paper P. The image forming apparatus A1 then outputs the paper P with the image formed thereon to the post-processing device A2. The post-processing device A2 receives the paper P and conveys the paper P to the folding section 51.

In Step S155, the folding section 51 folds the paper P with the image formed thereon. The folded paper P is then conveyed from the folding section 51 to the enclosing section 52.

In Step S157, the enclosing section 52 opens the opening of the envelope E with the address formed thereon and inserts the folded paper P into the envelope E. The process then advances to Step S159 in FIG. 9.

Figure 9:
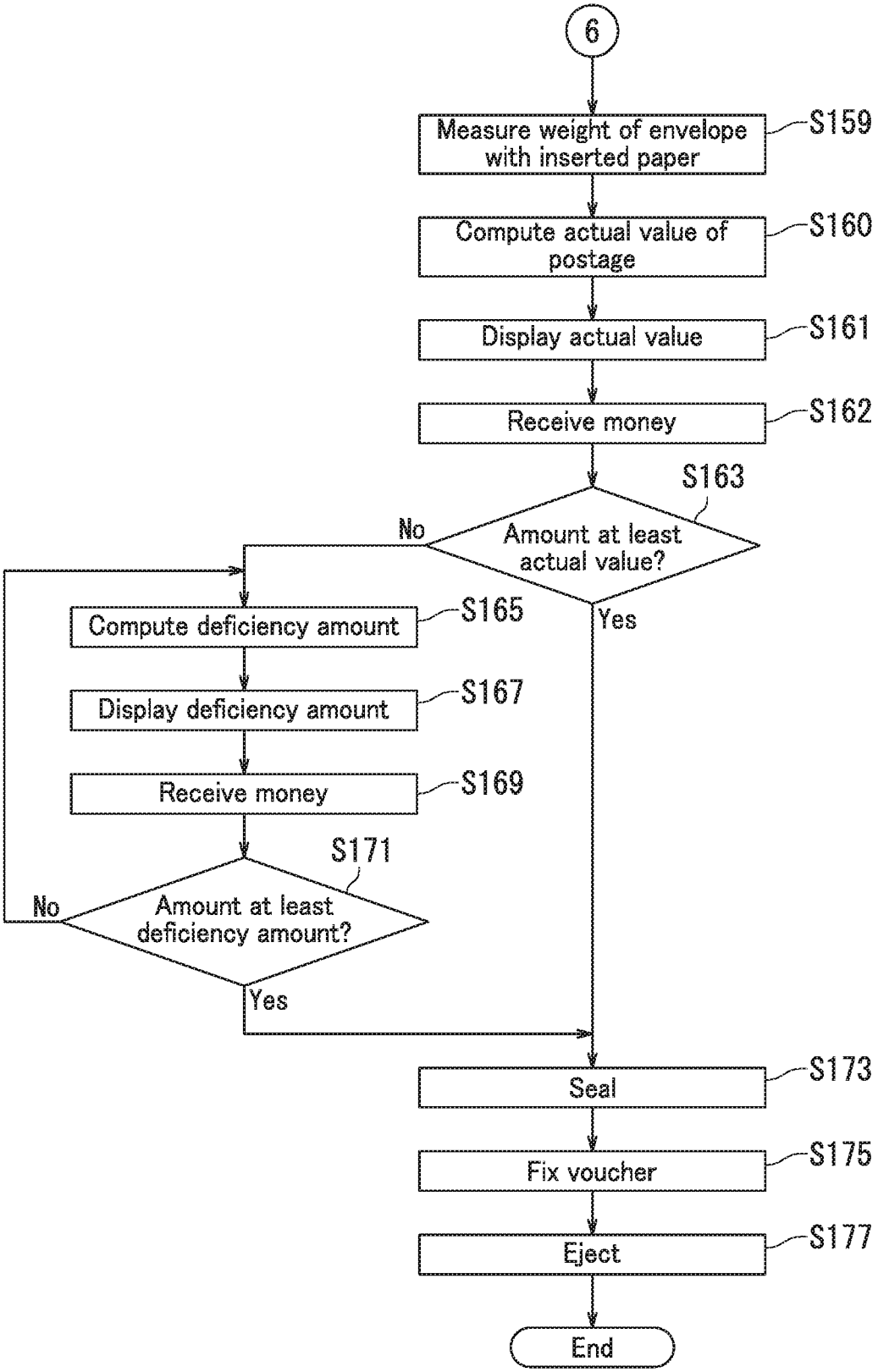
FIG. 9 is a flowchart illustrating another portion of the mail creation method according to the embodiment.

As illustrated in FIG. 9, the weight measuring section 53 measures the weight of the envelope E with the folded paper P inserted therein in Step S159.

In Step S160, the second computing section 72 computes the actual value AV of the postage based on the size of the envelope E and the actual value of the weight of the envelope E with the folded paper P inserted therein.

In Step S161, the display section b1 displays the actual value AV of the postage and a message. The message includes content requesting payment of a fee equivalent to the actual value AV of the postage.

In Step S162, the money receiving machine 5 receives money and computes an amount of received money.

In Step S163, the determining section 74 determines whether or not the amount of money received by the money receiving machine 5 in Step S162 is equal to or greater than the actual value AV of the postage.

When the determining section 74 determines that the amount of received money is equal to or greater than the actual value AV (Yes in Step S163), the process advances to Step S173.

When the determining section 74 determines that the amount of received money is less than the actual value AV by contrast (No in Step S163), the process advances to Step S165.

In Step S165, the third computing section 73 computes a fee deficiency amount (specifically a deficiency amount relative to the actual value AV) based on the actual value AV and the amount of received money. The deficiency amount is computed by subtracting the amount of received money from the actual value AV.

In Step S167, the display section b1 displays the deficiency amount and a message. The message includes content requesting payment of the deficiency amount.

In Step S169, the money receiving machine 5 receives money and computes an amount of received money.

In Step S171, the determining section 74 determines whether or not the amount of money received in Step S169 is equal to or greater than the deficiency amount.

When the determining section 74 determines that the amount of received money is less than the deficiency amount (No in Step S171), the process returns to Step S165. That is, when the determining section 74 determines that the amount of received money is less than the deficiency amount, the enclosing section 52 defers performance of Step S173 and the voucher fixing section 54 defers performance of Step S175.

When the determining section 74 determines that the amount of received money is equal to or greater than the deficiency amount by contrast (Yes in Step S171), the process advances to Step S173.

In Step S173, the enclosing section 52 seals the envelope E with the folded paper P inserted therein. The sealed envelope E is then conveyed from the enclosing section 52 to the voucher fixing section 54.

In Step S175, the voucher fixing section 54 fixes the voucher to the sealed envelope E. As a result, the article of mail is created. The envelope E with the voucher fixed thereto is then conveyed from the voucher fixing section 54 to the second ejection roller 58.

In Step S177, the second ejection roller 58 ejects the envelope E to the second ejection tray 59.

According to the present embodiment as described above with reference to FIG. 3, the display section b1 displays the first total value SM1 (=first service fee F1+predicted value PV of the postage) in the address forming mode (Step S15). Therefore, the user can insert a total amount (first total value SM1) of a required fee for a mail creation service into the money receiving machine 5 at one time because the total amount can be ascertained before processing of the envelope E and the paper P by the image forming system 100. As a result, burden for the user can be further reduced compared to a case in which the first service fee F1 and the postage are inserted into the money receiving machine 5 at different times. The burden for the user can also be further reduced in the address non-forming mode (Step S77) in the same manner as the address forming mode.

Note that in the address forming mode and the unspecified paper mode, the mail creation service indicates a series of processes performed by the image forming system 100 from address forming and image forming to voucher fixing. In the address non-forming mode, the mail creation service indicates a series of processes performed by the image forming system 100 from image forming to voucher fixing.

Also according to the present embodiment, the weight of the envelope E with the paper P inserted therein is measured to compute the actual value AV of the postage (Steps S39, S99, and S160). Accordingly, the burden for the user of measuring the weight of the envelope E with the paper P inserted therein can be eliminated.

Additionally according to the present embodiment, the enclosing section 52 performs the sealing process of Step S51 and the voucher fixing section 54 performs the fixing process of Step S53 after the determining section 74 determines that the amount of money received by the money receiving machine 5 is equal to or greater than the second total value SM2 (=first service fee F1+actual value AV of the postage) (Yes in Step S41) in the address forming mode. Accordingly, the process can be inhibited from advancing while the fee required for the mail creation service cannot be collected. That is, a situation in which the postage cannot be collected can be inhibited from occurring. The process also can be inhibited from advancing (Yes in Step S101, Steps S111, and S113) while the fee required for the mail creation service cannot be collected in the address non-forming mode in the same manner as the address forming mode.

Also according to the present embodiment, the series of processes from address forming and image forming to voucher fixing can be smoothly performed without interruption as long as an amount equal to or greater than the fee (second total value SM2) required for the mail creation service is inserted into the money receiving machine 5 (Yes in Step S41) in the address forming mode. As a result, a time period from the beginning to the end of the mail creation service can be shortened. The time period from the beginning to the end of the mail creation service can also be shortened in the address non-forming mode (Yes in Step S101) in the same manner as the address forming mode.

Additionally according to the present embodiment, the enclosing section 52 performs the sealing process of Step S51 and the voucher fixing section 54 performs the fixing process of Step S53 after money equal to or greater than the deficiency amount is received by the money receiving machine 5 (Yes in Step S49) in the address forming mode. Therefore, the process can be inhibited from advancing while the fee required for the mail creation service cannot be collected. That is, a state in which the postage cannot be collected can be inhibited from occurring. The process can also be inhibited from advancing while the fee required for the mail creation service cannot be collected in the address non-forming mode (Yes in Step S109) in the same manner as the address forming mode.

Furthermore according to the present embodiment, the convenience for the user can be increased because the address non-forming mode is included (Step S71). Particularly, the address non-forming mode is effective in a situation in which the user brings an envelope E with an address written thereon. In the address non-forming mode, the second service fee F2 not including a fee for address formation is presented to the user (Step S77). Therefore, the user can pay an appropriate fee, not an excessive fee.

Also according to the present embodiment, the first service fee F1 is displayed (Step S137) before the address formation process of Step S151 and the image formation process of Step S153 are performed in the unspecified paper mode. Before the sealing process of Step S173 is performed, the weight of the envelope E with the paper P inserted therein is measured and the actual value AV of the postage is displayed (Steps S159 to S161). Accordingly, the process from address forming and image forming to voucher fixing can be performed while presenting the first service fee F1 and the actual value AV of the postage to the user even when the size of the paper P is unknown (No in Step S7). Particularly, the unspecified paper mode is effective in a situation in which the user brings paper P of an unknown size.

Note that Steps S to S27 are performed before Steps S29 and S31. Steps S33 to S49 are performed after Steps S29 and S31 and before Step S51. Steps S17 to S55 are performed after Step S15.

Steps S71 to S90 are performed before Step S91. Steps S93 to S109 are performed after Step S91 and before Step S111. Steps S79 to S115 are performed after Step S77.

Steps S131 to S149 are performed before Steps S151 and S153. Steps S155 to S171 are performed after Steps S151 and S153 and before Step S173.

An embodiment of the present disclosure has been described above with reference to the drawings. However, the present disclosure is not limited to the above-mentioned embodiment and may be implemented in various manners within a scope not deviating from the essence thereof (as in below-mentioned (1) and (2), for example). Furthermore, various disclosures may be formed by appropriately combining constituent elements disclosed in the above-mentioned embodiment. For example, a number of the constituent elements may be removed from the entirety of constituent elements presented in the embodiment. Additionally, the constituent elements may be appropriately combined across differing embodiments. The drawings are schematic, emphasizing the constituent elements for ease of understanding. Properties of the constituent elements such as thickness, length, number, and interval thereof in the drawings may differ in practice from the above embodiment to facilitate preparation of the drawings. The properties of the constituent elements illustrated in the above-mentioned embodiment, such as material properties, shapes, and dimensions, are merely examples and are not intended as specific limitations, and can be altered in various manners within a scope not substantially deviating from the effects of the present disclosure.

(1) In Steps S9, S11, S73, and S133 described with reference to FIGS. 3, 6, and 8, the input section b2 may receive input of information indicating a printing method. The printing method is double-sided printing in which images are formed on both sides of the paper P or single-sided printing in which an image is formed on one side of the paper P. The first computing section 71 computes the first service fee F1 and the second service fee F2 by reflecting the printing mode. Note that in FIGS. 3 to 9, the first service fee F1 and the second service fee F2 are computed presuming single-sided printing.

When the printing method is double-sided printing, for example, the first computing section 71 multiplies the sheet quantity of the paper P by "2" to compute a product. A quantity "1" of the envelope E is added to the product to compute a sum. The first computing section 71 then multiplies an image formation unit price by the sum to compute a product. The product indicates the first service fee F1.

(2) Either Step S29 or Step S31 in FIG. 4 may be performed first. Either Step S151 or Step S153 of FIG. 8 may be performed first. Step S51 in FIG. 5 may be performed between Steps S35 and S37. Step S111 in FIG. 7 may be performed between Steps S95 and S97. Step S173 in FIG. 9 may be performed between Steps S157 and S159.

What is claimed is:

1. A mail creation method, comprising:

forming, by an image forming section, an address on an envelope;

forming, by the image forming section, an image on paper;

folding, by a folding section, the paper having the image formed thereon;

inserting, by an enclosing section, the folded paper into the envelope having the address formed thereon;

sealing, by the enclosing section, the envelope having the folded paper inserted therein;

fixing, by a voucher fixing section, a voucher to the sealed envelope, the voucher indicating that postage has been paid;

receiving, by an input section, input of a size of the envelope, a size of the paper, and a sheet quantity of the paper before the forming of the address and the forming of the image;

computing, by a first computing section, a first service fee and a predicted value of the postage based on the size of the envelope, the size of the paper, and the sheet quantity of the paper, before the forming of the address and the forming of the image; and displaying, by a display section, the first service fee, the predicted value, and a first total value before the forming of the address and the forming of the image, the first total value indicating a total of the first service fee and the predicted value, wherein the first service fee indicates a fee for a service of the forming of the address on the envelope and the forming of the image on the paper.

2. The mail creation method according to claim 1, further comprising:

receiving money and computing an amount of the money by a money receiving section, before the forming of the address and the forming of the image;

measuring, before the sealing and by a weight measuring section, a weight of the envelope having the folded paper inserted therein;

computing, before the sealing and by a second computing section, an actual value of the postage based on the size of the envelope and an actual value of the weight of the envelope having the folded paper inserted therein; and determining, before the sealing and by a determining section, whether or not the amount of the money is equal to or greater than a second total value indicating a total of the first service fee and the actual value of the postage, wherein the sealing is performed by the enclosing section and the fixing of the voucher is performed by the voucher fixing section after the amount of the money is determined to be equal to or greater than the second total value.

3. The mail creation method according to claim 2, further comprising:

computing, by a third computing section, a fee deficiency amount based on the second total value and the amount of the money, when the amount of the money is determined to be less than the second total value; and displaying, by the display section, the deficiency amount, wherein the enclosing section defers the sealing and the voucher fixing section defers the fixing of the voucher when the amount of the money is determined to be less than the second total value, and the enclosing section performs the sealing and the voucher fixing section performs the fixing of the voucher after the money receiving section receives money equal to or greater than the deficiency amount.

4. A mail creation method, comprising:

forming, by an image forming section, an address on an envelope;

forming, by the image forming section, an image on paper;

folding, by a folding section, the paper having the image formed thereon;

inserting, by an enclosing section, the folded paper into the envelope having the address formed thereon;

sealing, by the enclosing section, the envelope having the folded paper inserted therein; and fixing, by a voucher fixing section, a voucher to the sealed envelope, the voucher indicating that postage has been paid, wherein the mail creation method has:

an address forming mode in which the address is formed on the envelope; and an address non-forming mode in which the address is not formed on the envelope, the address forming mode includes the forming of the address, the forming of the image, the folding, the inserting, the sealing, and the fixing of the voucher, the address non-forming mode includes:

receiving, by an input section, input of a size of the envelope, a size of the paper, and a sheet quantity of the paper;

computing, by a first computing section, a second service fee and a predicted value of the postage based on the size of the envelope, the size of the paper, and the sheet quantity of the paper;

displaying, by a display section, a third total value, the second service fee, and the predicted value, the third total value indicating a total of the second service fee and the predicted value;

forming, by the image forming section, the image on the paper after the displaying;

folding, by the folding section, the paper having the image formed thereon;

inserting, by the enclosing section, the folded paper into the envelope;

sealing, by the enclosing section, the envelope having the folded paper inserted therein; and fixing, by the voucher fixing section, the voucher to the sealed envelope, and the second service fee indicates a fee for a service of the forming of the image on the paper without the forming of the address on the envelope.

5. A mail creation method, comprising:

forming, by an image forming section, an address on an envelope;

forming, by the image forming section, an image on paper;

folding, by a folding section, the paper having the image formed thereon;

inserting, by an enclosing section, the folded paper into the envelope having the address formed thereon;

sealing, by the enclosing section, the envelope having the folded paper inserted therein;

fixing, by a voucher fixing section, a voucher to the sealed envelope, the voucher indicating that postage has been paid;

receiving, by an input section, input of a size of the envelope and a sheet quantity of the paper before the forming of the address and the forming of the image;

computing, by a first computing section, a first service fee based on the sheet quantity of the paper, before the forming of the address and the forming of the image;

displaying, by a display section, the first service fee before the forming of the address and the forming of the image;

measuring, before the sealing and by a weight measuring section, a weight of the envelope having the folded paper inserted therein;

computing, before the sealing and by a second computing section, an actual value of the postage based on the size of the envelope and an actual value of the weight of the envelope having the folded paper inserted therein; and displaying, before the sealing and by the display section, the actual value of the postage, wherein the first service fee indicates a fee for a service of the forming of the address on the envelope and the forming of the image on the paper.

6. The mail creation method according to claim 1, wherein the input section receives input of information indicating a printing method, the printing method indicates a double-sided printing method in which images are formed on both sides of the paper or a single-sided printing method in which an image is formed on one side of the paper, and the first computing section computes the first service fee by reflecting the printing method.

7. The mail creation method according to claim 4, wherein the input section receives input of information indicating a printing method, the printing method indicates a double-sided printing method in which images are formed on both sides of the paper or a single-sided printing method in which an image is formed on one side of the paper, and the first computing section computes the second service fee by reflecting the printing method.

8. An image forming system which performs the mail creation method according to claim 1, the image forming system comprising:

the image forming section;

the folding section;

the enclosing section;

the voucher fixing section;

the input section;

the first computing section; and the display section.

9. An image forming system which performs the mail creation method according to claim 4, the image forming system comprising:

the image forming section;

the folding section;

the enclosing section;

the voucher fixing section;

the input section;

the first computing section; and the display section.

10. An image forming system which performs the mail creation method according to claim 5, the image forming system comprising:

the image forming section;

the folding section;

the enclosing section;

the voucher fixing section;

the input section;

the first computing section;

the display section;

the weight measuring section; and the second computing section.

* * * * *